US005735419A

United States Patent [19]

Ma

[11] Patent Number: 5,735,419

[45] Date of Patent: Apr. 7, 1998

[54] RESEALABLE PLASTIC SNAP-FIT CLOSURE WITH ANTI-TAMPER FUNCTION

[75] Inventor: Xiaoli Ma, Bartlett, Ill.

[73] Assignee: Crown Cork & Seal Company, Inc., Philadelphia, Pa.

[21] Appl. No.: 606,042

[22] Filed: Feb. 16, 1996

[51] Int. Cl.[6] ..... B65D 55/02

[52] U.S. Cl. ..... 215/253; 215/254; 215/256

[58] Field of Search ..... 215/253, 254, 215/255, 252, 256

[56] References Cited

U.S. PATENT DOCUMENTS

| | | | |
|---|---|---|---|
| 4,371,089 | 2/1983 | Barendregt | 215/253 |
| 4,478,343 | 10/1984 | Ostrowsky | 215/253 |
| 4,546,892 | 10/1985 | Couput | 215/253 |
| 4,602,718 | 7/1986 | Dutt | 215/253 |
| 4,782,964 | 11/1988 | Poore et al. | 215/253 |
| 5,108,029 | 4/1992 | Abrams et al. | 229/125 |

FOREIGN PATENT DOCUMENTS 673 849 A1 9/1995 European Pat. Off. .

*Primary Examiner*—Joseph M. Moy

*Attorney, Agent, or Firm*—Woodcock Washburn Kurtz Mackiewicz & Norris LLP

[57] ABSTRACT

A plastic closure includes an annular ring durably attached to the container, and a sealing assembly installed in the ring to seal the mouth. The sealing assembly includes a plug having a sealing lip on its lower face and a release lever connected to the plug by a flexible linkage. The tab on the release lever can be lifted to pry the sealing assembly out of the opening. The lever comprises more than one hook protruding downwardly, connected to the outer edge of the lever by frangible bridges or by a frangible line. The hook is engageable with retaining elements attached to the attachment ring or to the container. The frangible bridges or the frangible line are constructed to break during first opening of the closure, to provide an indication that tampering has occurred.

14 Claims, 3 Drawing Sheets

RESEALABLE PLASTIC SNAP-FIT CLOSURE WITH ANTI-TAMPER FUNCTION

BACKGROUND OF THE INVENTION

This invention relates to a closure for liquid containers, and in particular to a snap-fitting plastic closure for beverage containers or the like.

Many versions of closures are known that are attached either inside or outside the mouth of a container. Some snap-in closures, for example, are attached to a circumferential ring on the mouth of the container and have a sealing element. Frequently, a two-part sealing element comprising a plug and a release lever are used, the plug being connected by means of a hinge to the attachment ring and the release lever being connected to the plug by a web. If the plug is in the closed position, it will form a seal on the attachment ring. The plug is released from the attachment ring by raising the lever.

Anti-tamper devices for such snap-fitting closures are known that work between the upper side of the plug and the release lever. In order to open the closure, the release lever is raised upwards and separated from the plug, thus activating the anti-tamper function.

A disadvantage of current snap-fit closures is that in order to open the closures, it is not absolutely necessary to remove the release lever from the sealing plug. It might, for example, be possible to open and reclose such closures with the aid of a tool, without separating the release lever and the sealing plug from one another.

SUMMARY OF THE INVENTION

It is an object of the invention to avoid the disadvantages of known closures, and in particular, to create a snap-in plastic closure that reliably performs an anti-tamper function and can be manufactured both simply and economically.

This purpose is fulfilled by a plastic closure having a circumferential attachment ring as well as a sealing means. The attachment ring can be permanently attached to the container mouth. A seal is arranged within the attachment ring so as to form a seal between with the attachment ring and with the container mouth. The seal comprises a plug with a sealing lip on its underside, the sealing lip engaging with the attachment ring or with the container mouth. In addition, the closure has a release lever connected to the plug by means of a web.

The release lever includes one or more radial hooks extending downwards from the release lever, connected by means of frangible bridges or frangible lines with the outer edge of the release lever. This hook can be brought into engagement with a retainer, which is directly or indirectly attached to the container mouth. In the original closed position, the release lever is connected with the retainer via the hook. On initial opening of the closure, the release lever assumes a new position in relation to the neck of the container, and the frangible lines or frangible bridges break. Broken frangible bridges or broken frangible lines indicate unauthorized opening of the closure.

The retaining elements are preferably formed integral with the circumferential attachment ring. The hooks are in principle symmetrically arranged, and each hook is preferably connected with the release lever by one or more frangible bridges. Non-symmetrical arrangements are also possible.

The hook is preferably formed by a section of the ring which has a circumferential outward protrusion at its lower end. It would also be conceivable to only provide individual protrusions at the lower end of the arcuate segment.

In a preferred embodiment, the sealing plug is additionally provided with a vent hole, the release lever having a plug formed on its lower surface for sealing engagement in the vent hole. In addition, the release lever optionally has a depression forming an optimum pressure point for facilitating resealing of the closure.

In a further preferred embodiment, the release lever has a protruding tab arranged opposite the web connecting the release lever with the sealing plug. With the aid of the tab, the release lever can easily be raised upwards.

The attachment ring is preferably attached to the outer surface of the container mouth, the sealing lip being in direct sealing engagement with the inside surface of the container mouth.

In an alternative embodiment, the attachment ring is provided at least partially within the container mouth so that the sealing lip of the sealing plug is in sealing engagement with the inside surface of the attachment ring.

Preferably, in addition the attachment ring comprises a seating surface for the release lever. When the closure is closed, the seating surface is arranged adjacent to the web between the release lever and the plug. On opening the closure, the seating point serves as a point of rotation for the release lever. By means of the release lever action, the sealing plug can be easily removed from the container opening.

The hooks can be arranged on both sides of the protruding tab. The hook or hooks might, alternatively, be located only on one side of the protruding tab and extend less that 180° over a segment of the ring.

The release lever can also comprise a surrounding skirt portion connected to its outer edge. In this case, the hooks are attached to the lower free edge of the skirt portion.

When the frangible connection is broken, the hooks fall into the retainer. Depending on the dimensions of the skirt portion and the retainer and the location of the frangible connection, the top portion of the hook will be above or below the upper surface of the retainer.

DESCRIPTION OF THE PREFERRED EMBODIMENT

Figure 1:
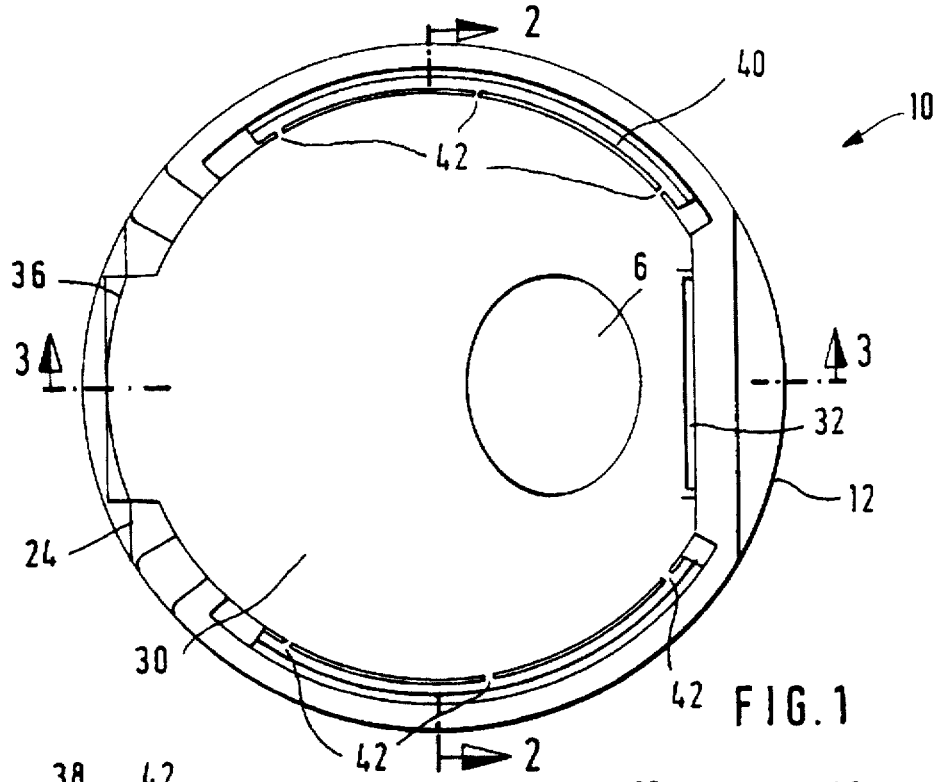
FIG. 1 is a plan view of a resealable snap-fit plastic closure with the features of the invention.
Figure 2:
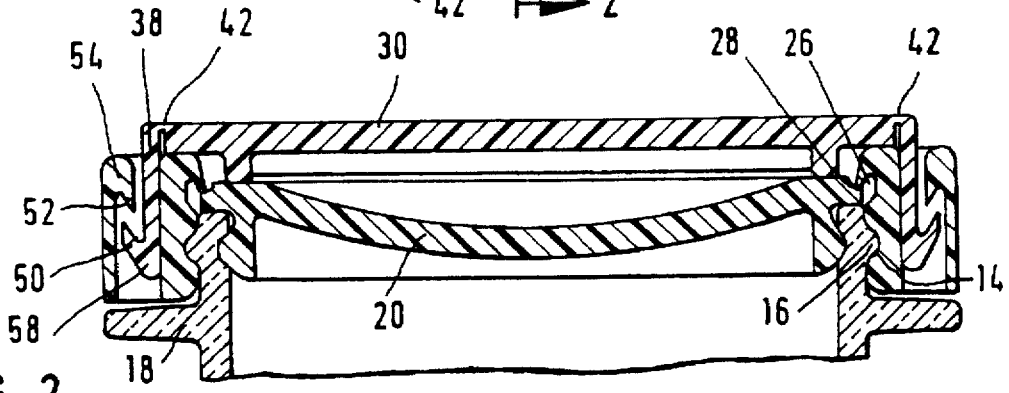
FIG. 2 is a cross-section taken on the section plane 2–2 in FIG. 1.
Figure 3:
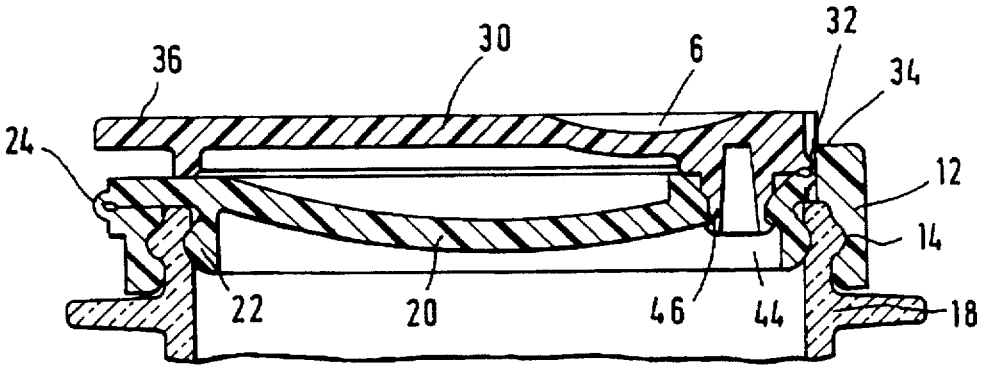
FIG. 3 is a cross-section taken on the section plane 3–3 in FIG. 1.

As shown in FIGS. 1 to 3, a snap-fit closure 10 embodying the invention is attached to a container mouth by means of a circumferential attachment ring 12. The attachment ring 12 has a circumferential groove 14 that engages a circumferential bead 16 on the container mouth. As the attachment ring 12 is placed on the container mouth 18, its groove 14 snaps over the bead 16 and is thereafter held within the container mouth 18. Alternatively, one might join the attachment ring to the container mouth by other means such as adhesive bonding or welding.

The container mouth 18 is closed by means of a sealing plug 20 having a circumferential sealing lip 22 which engages the inside surface of the container mouth 18. The sealing plug 20 is connected to the attachment ring 12 by means of a hinge 24. The circumferential ring 12 is formed with an internal skirt 26 which engages a circumferential protrusion 28 to retain the plug within the mouth. The sealing plug thus cannot be lifted away, even when the pressure in the container is raised.

The plug 20 is connected to a release lever 30 by a web 32 arranged opposite the hinge 24. With the closure in its closed position, the release lever 30 lies with its lower surface against the upper side of the sealing plug 20. To open the closure, the release lever 30 is pulled upwards and then rotated in the clockwise (FIG. 3) direction. To facilitate grasping and lifting the release lever 30, a protruding tab 36 is provided. At the end of its travel, the release lever 30 contacts a shoulder 34 of the attachment ring 12. Further movement of the lever pries the sealing plug 20 outward with sufficient force to release the protrusion 28 from beneath the internal skirt 26 of the attachment ring.

The lower portion of the attachment ring 12 encompasses 360° of the container mouth; in contrast, a recess is provided in the upper portion of the ring such a way that the tab 36 is not covered, making the tab easy to grasp.

Figure 4:
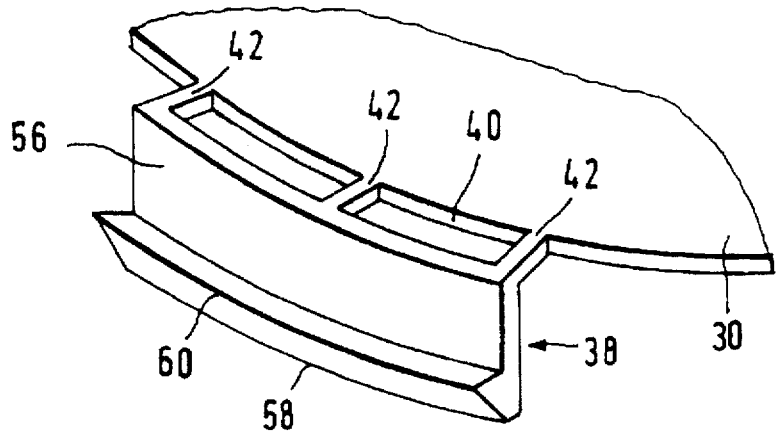
FIG. 4 is an enlarged representation of the hook.
Figure 5:
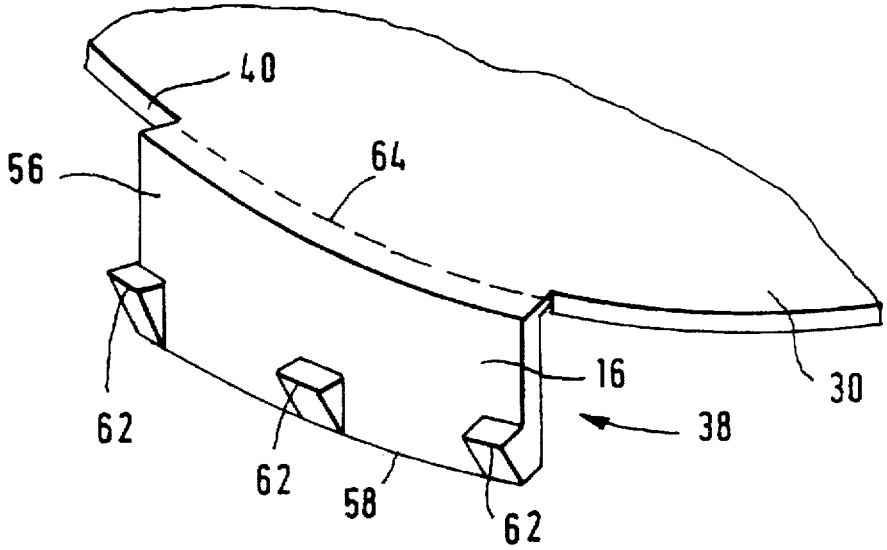
FIGS. 5 and 6 are enlarged representations of the retaining hooks of two alternative embodiments.

Now with reference to FIGS. 2, 4 and 5, the closure includes at least one hook 38 extending downwards from the lever 30 and connected to the lever's outer edge 40 by means of frangible bridges 42. Each hook 38 can be brought into engagement with a complementary retainer 54, formed integral with the attachment ring 12. The release lever 30 is thus initially connected with the attachment ring 12 by frangible bridges. The container is closed, after being filled initially, and the release lever 30 is hooked with its hooks 38 into the retaining means.

When the release lever is raised in order to open the closure, the frangible bridges 42 break, thereafter indicating that the closure has been opened at least once.

The sealing plug is also provided with a vent hole 44, which can be closed by a vent plug 46 on the lower side of the release lever 30. When the closure is opened, the sealing plug 46 is removed from the vent hole 44 before the protrusion 28 of the sealing plug 20 is freed from beneath the skirt 26. In this way, pressure is released through the vent hole 44 without the risk of the sealing plug 20 blowing off.

The lower end 58 of the hook 38 has a barb 50 protruding radially outward. The upper surface of this barb engages beneath a retaining surface 52 of the retainer 54. In this way, the hook 38 is held fast in the retainer 54.

The closure is manufactured integral and flat, and is then folded so that the sealing plug 20 comes to lie within the attachment ring 12 and the hooks 38 engage with the retainer 54. Preferably, the sealing plug is pressed into the attachment ring prior to attaching the ring 12; however, it is also possible to first attach the attachment ring 12 onto the container mouth 18, and then to press the sealing plug 20 into the container mouth opening 18, only thereafter engaging the hooks 38 with the retainer 54.

Once the closure has been opened for the first time, it can be resealed by pressing the sealing plug 20 into the container mouth opening, where it is retained by the attachment ring 12. An optional depression 6 on the upper side of the release lever 30 indicates the optimum position for applying the pressure required for reclosure.

In the preferred form the invention, there are two hooks, arranged symmetrically on either side of the lift tab. FIG. 4 shows a perspective view of one such hook 38. The hook 38 is formed as an arcuate member 56. At the lower end 58 of the arcuate member 56, there is a circumferential barb 60 directed outward, which barb engages with the retainer 54. The arcuate member 56 is connected to the outer edge 40 of the release lever 30 by means of three frangible bridges.

FIG. 5 shows a slightly modified embodiment of the hook 38. In place of an continuous barb 60, individual outwardly pointing barbs 62 are provided on the lower end 58 of the arcuate element 56. The arcuate element 56 is connected to the outer edge 40 of the release lever 30, a frangible connection 64 being formed between the arcuate element 56 and the release lever 30.

Figure 6:
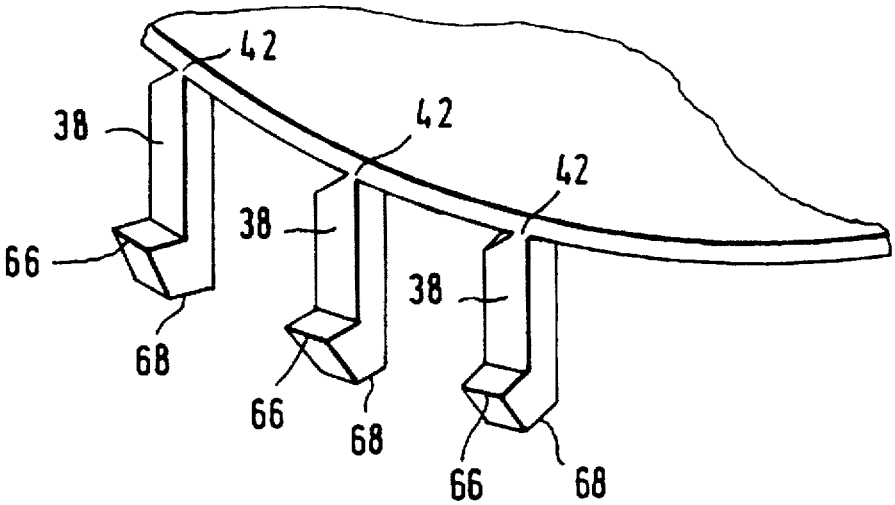

In the embodiment shown in FIG. 6, the retaining hooks are formed by individual elements, each having an outwardly pointing barb 66 at its lower end 68.

Figure 7:
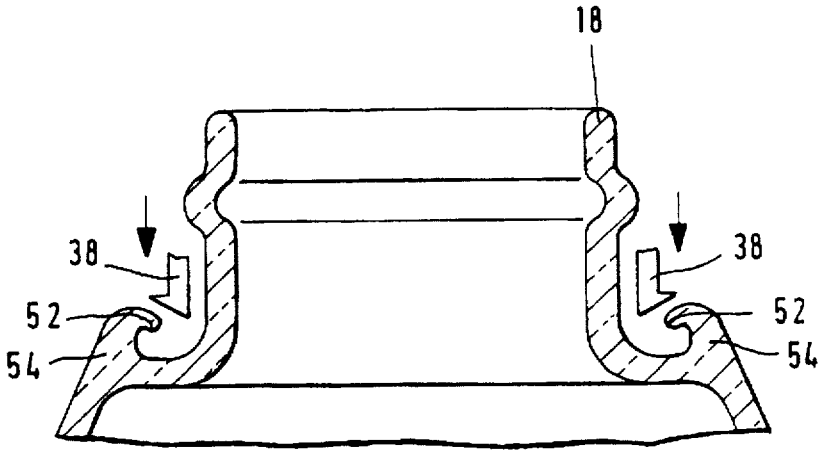
FIG. 7 a cross-section of a further embodiment of the invention.

In an alternative embodiment (FIG. 7), the retainer 54 is connected not to the closure 10, but, rather, directly to the container mouth 18. The retainer 54 on the container mouth 18 has a retaining surface 52 that can be engaged with the hook 38 of a closure 10.

It should in principle also be possible to connect the hooks 38 firmly to the release lever 30 and instead to connect the retainer 54 with the circumferential attachment ring 12 via frangible bridges or frangible lines. With this arrangement, on initial opening of the closure 10, the retainer is separated from the attachment ring 12, and unauthorized opening is evident. Such an arrangement has a disadvantage compared to the aforementioned embodiments, of course, in that the hooks are more exposed.

Figure 8:
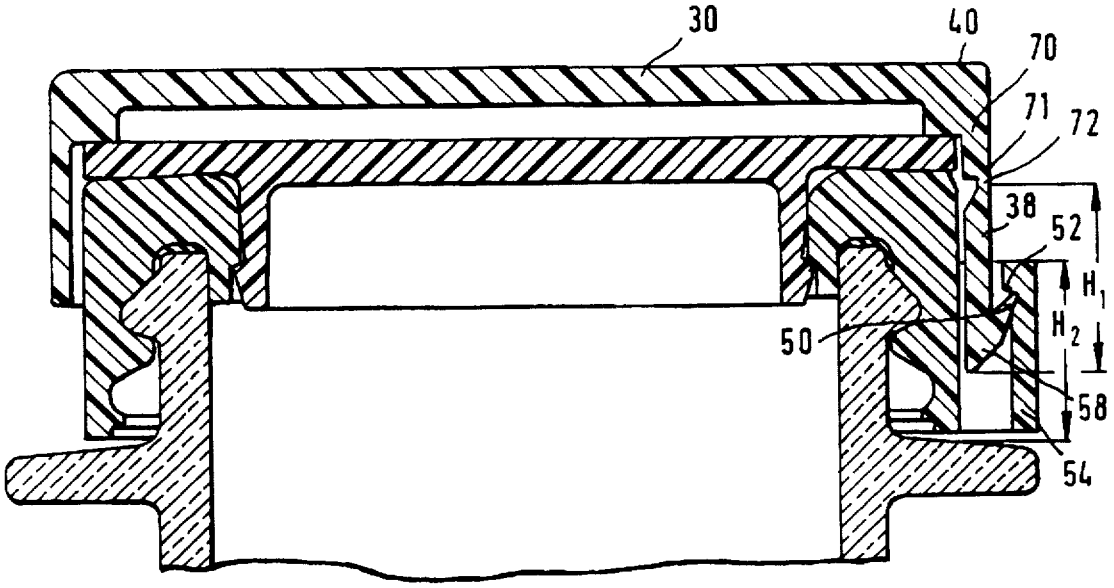
FIG. 8 is a cross-section of a further embodiment of the invention.

In the embodiment shown in FIG. 8, the lever 30 comprises a surrounding skirt potion 70 connected to its outer edge 40. The hooks 38 are connected to the lower free edge 71 of the skirt portion 70 by means of frangible bridges 72.

The lower end 58 of the hook 38 has a barb 50 protruding radially outward. The upper surface of this barb engages beneath a retaining surface 52 of the retainer 54. In this way, the hook 38 is held fast in the retainer 54.

When the closure is opened, the frangible bridges 72 are broken and the hook 38 falls into the retainer 54.

Depending of the height H2 of the retainer 54 and the distance H1 between the lower end 58 of the hook and the frangible bridge 72, the top portion of the hook 38 is arranged above or below the top of the retainer 54, when the frangible bridge 72 is broken.

The closure is preferably made of a thermoplastic material such as polyethylene, polypropylene or PET. Standard injection molding methods can be used in manufacture. It is, however, also conceivable to manufacture closures according to the invention by the "Compression Molding" method.

The closure is preferably manufactured integral and flat, and is folded together for use. In order to improve the sealing properties, an additional sealing device such as an O-ring or a liner between the attachment ring 12 and the container mouth 18 and/or between the attachment ring 12 and the sealing plug 20 might be added.

Inasmuch as the invention is subject to modifications and variations, the foregoing description and accompanying drawings should not be regarded as limiting the invention, which is defined by the following claims and various combinations thereof:

I claim:

1. In a closure for sealing the mouth of a container, said closure comprising an attachment ring for durable installation on the container at its mouth, said ring having an opening substantially coextensive with said mouth, a sealing assembly installed in said ring to sealingly engage the mouth, said assembly comprising a plug having a sealing lip and an annular protrusion extending outwardly beyond the lip, and a release lever connected to said plug, to pry the plug out of the opening, the improvement wherein said release lever comprises at least one radial hook extending downwardly from the lever and being attached to the outer edge of the lever by frangible means, said hook being engageable with retainer, connected to the mouth of the container, directly or indirectly, the lever being connected to the retainer in its closed position by means of the hook, the frangible means being constructed to break when the lever is lifted during a first opening of the closure.

2. The invention of claim 1, wherein the release lever is connected to the plug by a web so as to be pivotable from a first closed position in which it is about parallel to the surface of the plug to a second opening position in which it protrudes upwardly from the plug to serve as an opening handle.

3. The invention of claim 2, wherein the release lever comprises a tab opposite the web connecting the lever to plug, and the tab extends outward sufficiently to be easily lifted.

4. The invention of claim 3, whereas the hooks are symmetrically disposed on both sides of the tab.

5. The invention of claim 2, wherein the release lever in its opening position bears against a portion of the ring, which acts as a fulcrum to pry the plug out of the opening.

6. The invention of claim 1, wherein the hooks are disposed on one side of the tab, whereby the hooks extend over an angle less than 180°.

7. The invention of claim 1, wherein the plug is integrally connected to the attachment ring and the lever is integrally connected to the plug.

8. The invention of claim 1, wherein each hook is attached to the lever by more than one frangible bridge.

9. The invention of claim 1, wherein each hook is attached to the lever by a frangible connection.

10. The invention of claim 1, wherein the retainer is formed integrally with the attachment ring.

11. The invention of claim 1, wherein the hooks are symmetrically disposed on the periphery of the lever.

12. The invention of claim 1, wherein the hooks are formed by an arcuate segment, having a barb extending radially outwardly on its lower end, the barb being engageable with a retaining surface of the retainer.

13. The invention of claim 1, wherein the plug has a vent hole and the release lever has a vent plug on its lower surface which fills the vent hole when the release lever is in said closed position.

14. The invention of claim 1, wherein the ring is mounted partially within the container's mouth, and the sealing lip bears against the inside surface of the ring.

* * * * *